US005463962A

United States Patent [19]

Gnezdilov

[11] Patent Number: 5,463,962

[45] Date of Patent: Nov. 7, 1995

[54] ROLLER COASTER

[76] Inventor: Vladimir A. Gnezdilov, Kastanaevskaia 60-179, Moscow, Russian Federation, 121108

[21] Appl. No.: 154,705

[22] Filed: Nov. 18, 1993

[30] Foreign Application Priority Data

Oct. 19, 1993 [RU] Russian Federation ..... 93048214

[51] Int. Cl.[6] ..... A63G 31/00

[52] U.S. Cl. ..... 104/55; 104/53

[58] Field of Search ..... 104/53, 55, 56, 104/63, 28, 124, 125, 126, 27, 30, 31; 446/75, 444

[56] References Cited

U.S. PATENT DOCUMENTS

| | | | |
|---|---|---|---|
| 1,805,266 | 5/1931 | Traver | 104/63 |
| 3,631,805 | 1/1972 | Schwarzkopf | 104/63 |
| 4,029,019 | 6/1977 | Watkins | 104/124 |
| 4,433,504 | 2/1984 | Terui | 446/75 |

FOREIGN PATENT DOCUMENTS

| | | | |
|---|---|---|---|
| 810327 | 7/1927 | Australia | 104/55 |
| 246075 | 3/1926 | Italy | 104/63 |

*Primary Examiner*—Mark T. Le
*Assistant Examiner*—Linh Do
*Attorney, Agent, or Firm*—Frishauf, Holtz, Goodman, Langer & Chick

[57] ABSTRACT

To provide a compact stiff structure for a roller coaster, main bearing posts (3) are coupled at one end to support elements (1, 35) and at other ends to a closed path track (4) on which passenger cars can move. The track is formed of successive sections which present a spatial figure of varying curvature. These sections form, selectively, passenger loading and unloading sections (22, 23, 24); a hoisting section (8), a descending section (10), in the direction of the travel of the car, downstream of a peak point (9), spiral, S-shaped, and turn sections (20, 21, 50, 51, 52) and, further, a closed loop (17) arranged in, essentially, a vertical plane. The peak (18) of the loop (17) is located below peaks (9, 15) of ascending and descending sections, and the track sections above the loop are coupled to the loop by additional stiff posts (19). The path of travel of the cars is up a hoist section (8) to a peak (9), then through descending (10, 12) and ascending (11, 13) sections with intervening turns (50, 51) into the loop (17), over the peak (18) and then, with more turns, S-shaped sections (21) and/or spiral sections (52, 20, 21), through the loop (17), to terminate at the passenger loading/unloading section (22–24). Preferably, the loading/unloading section is a structure which has a central part (23) carrying the track, and laterally projecting wing parts (22, 24), with guard walls, which can be folded over the cars to form a compact shipping unit.

18 Claims, 13 Drawing Sheets

ROLLER COASTER

Reference to related patent, the disclosure of which is hereby incorporated by reference:

U.S. Pat. No. 3,631,805, Schwarzkopf

Reference to related publications:

Brochure "SDC, WINDSTORM AND HURRICANE ROLLERCOASTERS", edition of September 1992.

Brochure Pax-Park Ltd. Moscow Russia "Russia is the Homeland of Roller Coasters 1757–1992", including "A Commercial Offer of the company Pax-Park Ltd., Moscow, Russia, for 1993.

1. Field of the Invention

The invention relates to amusement rides, and particularly to roller coasters, with a track of a closed sophisticated configuration which includes a vertical loop.

2. Background

The development of the amusement industry has led to the search of new designs of various attractions where passengers ride along paths with a complex trajectory. During these rides the passengers experience the greatest thrill and excitement when they are passing tracks with looping and sharply inclined banked turns.

In particular, there is a well-known Japanese ride (see the Japanese Patent Application 60-99285 (A63G), Apr. 21, 1983), in which the path along which carriages move is formed of several loop sections that follow each other. In order to clear these loop sections successfully, the train, made up of a few passenger cars and moving under force of gravity and stored energy, or inertia, must gain a certain speed. This path requires a lot of space and a great number of bearing supports which makes the ride unwieldy. Moreover large capital expenses are necessary for its erection.

Another ride (see U.S. Pat. No. 3,631,805) of the roller coaster type has a figure-eight path, i.e. an elongated loop. There is a hoisting section of the path on one of the sides of the loop followed by a descending section which runs along the whole opposite side of this loop from the highest to the lowest trajectory level. The track of this path is formed with parallel tube rails connected in their axial plane by means of transverse and diagonal struts raised above the supporting trestle with the help of posts that ensure a gap for the braking components of the cars passing near the axles of the wheels outside of the rails, as the cars move along the track. A station is provided for passenger loading and unloading located at one end of the loop. This permits reduction of the area occupied by the ride. The slope sections on the track occupy more space. This allows the cars to gain high speed and to acquire the energy necessary to get over the very steep and high rises in the opposite directions.

The above structure provides a thrilling ride. Yet, there is little variation in the form of the path of the ride. It consists of alternating rises, turns and slopes. Besides the longer length of the track required to achieve high speeds, greatly increases the area occupied by the ride.

The closest to this ride, by engineering design and the produced sensation, is a ride of the roller coaster type that includes a base with supporting elements mounted thereon. Posts supporting a track for the movement of passenger cars have one end secured to the track; the other ends of the posts are fastened to the supporting elements (see booklet of Pax-Park Co., Ltd., Moscow, 1992). This ride can be erected directly on the construction site without a foundation. The track has a closed trajectory and is made in the form of successive path sections intended for passenger loading and unloading, a powered ascent or hoisting section, descent and braking as well as of sections provided with a vertical loop, i.e. a loop in a vertical plane.

Cars joined together to form a train bring passengers up to the loading platform situated at the side of the roller coaster. After loading, they are driven to the track by the force of gravity. The movement of the train along the powered ascent or hoist section is carried out by means of a driving mechanism.

This ride provides substantial thrills. It combines alternating rises, slopes and banks with a vertical loop section located somewhat behind the lifting section. Nevertheless, it is to be noted that the location of the loop section at the beginning of the track does not permit experiencing the most satisfying sensation as a result of later passing through connecting track sections. Besides, this location of the loop section requires an increase of the numbers of supports in order to stiffen the track. It should also be noted that the absence of the structural interconnection between the main components of the ride—the track, the passenger train and the loading/unloading platform—considerably impedes the assembly and disassembly of the structure.

THE INVENTION

It is an object of the invention to create a roller coaster with a track layout ensuring maximum entertainment effect by heightening varying g-force sensations caused by alternating rises and slopes in the vertical plane with horizontal banks and having a reliable structure with a high degree of stiffness, in which one or more loop sections are coupled with the other structural components, while providing for minimum assembly and disassembly time of the structure.

Briefly, the roller coaster includes supporting elements mounted on a base. Posts are fastened are fastened thereto at one end thereof. The other ends of the posts support a track for the movement of passenger cars. The track has a closed path or trajectory in the form of successive track sections forming a set of sections. These sections include a passenger loading and unloading section, a power hoist or ascent section, descent sections, dynamic ascent sections, turn and spiral or S-shaped sections, braking sections as well as at least one section provided with an upright loop, that is, a loop in an essentially vertical plane.

In accordance with a feature of the invention, the set of all track sections is a spatial figure of changing curvature in which at least one section is located in the zone between the entrance to or exit from at least one of the closed upright, or vertical loop sections. This at least one section is mounted above the peak of the respective vertical loop section, and is joined to the vertical loop section by additional support and connecting posts, so that the vertical loop section is securely coupled to another section, for example a dynamic ascent-descent section at a peak thereof.

In accordance with a preferred feature of the invention, the spatial figure of the track has the extreme or peak or zenith points of successively diminishing heights positioned in the central part of a projection on the vertical plane of the track and arranged one above the other in the area of one of the upright, or vertical loop section or sections. Rises and descending slopes are disposed on different sides of the extreme or peak points. They are connected, selectively, to at least one ascending spiral section or an S-shaped section of the track located on one side of the loop section and/or to at least one S-shaped section at the other side.

In accordance with an embodiment of the invention, the sections on different sides of the extreme or peak points are an ascending spiral section and a descending spiral section of the track on different sides of the loop section.

In accordance with another embodiment of the invention, the rising and descending sloping sections on different sides of the loop section are connected with the S-shaped sections.

The supporting elements of the roller coaster are securely coupled or tied with the main posts by means of an adjustable intermediate unit which provides for a changeable angle and changeable height of the attachment of each post.

Preferably, the loading/unloading platform is made of at least three parts interconnected by means of hinges, a section with rails being disposed in the central part, and a platform with a guard section, wall or fencing being pivotably mounted on each side of this section.

The above structure of the roller coaster as a whole allows the cars to get over the loop sections and the banked turns with a greater degree of reliability, with the passengers experiencing the wonderfully thrilling sensation of "free flight".

DRAWINGS

DETAILED DESCRIPTION

Figure 9:
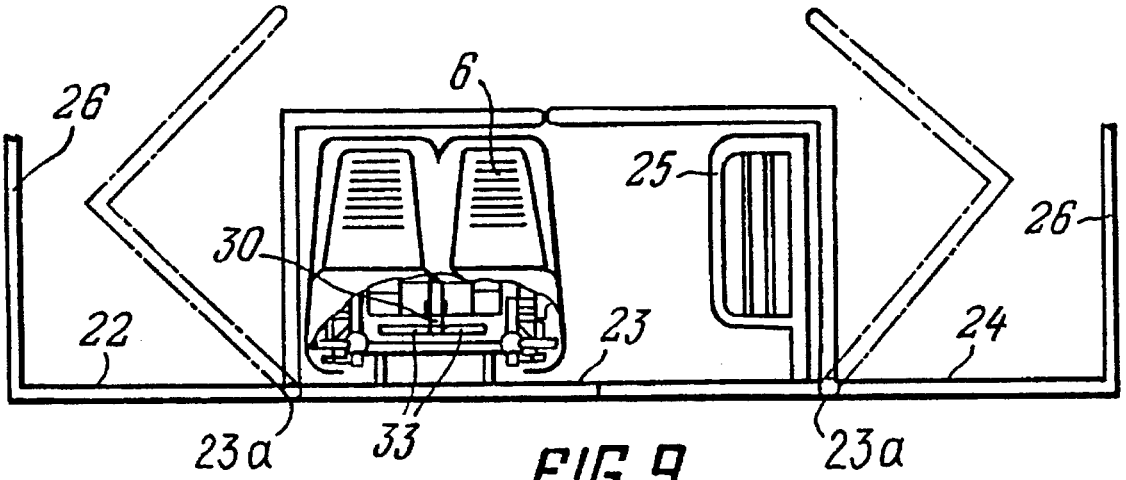
FIG. 9 is a side of the loading/unloading platform in the direction of arrow A shown in FIG. 8.
Figure 13:
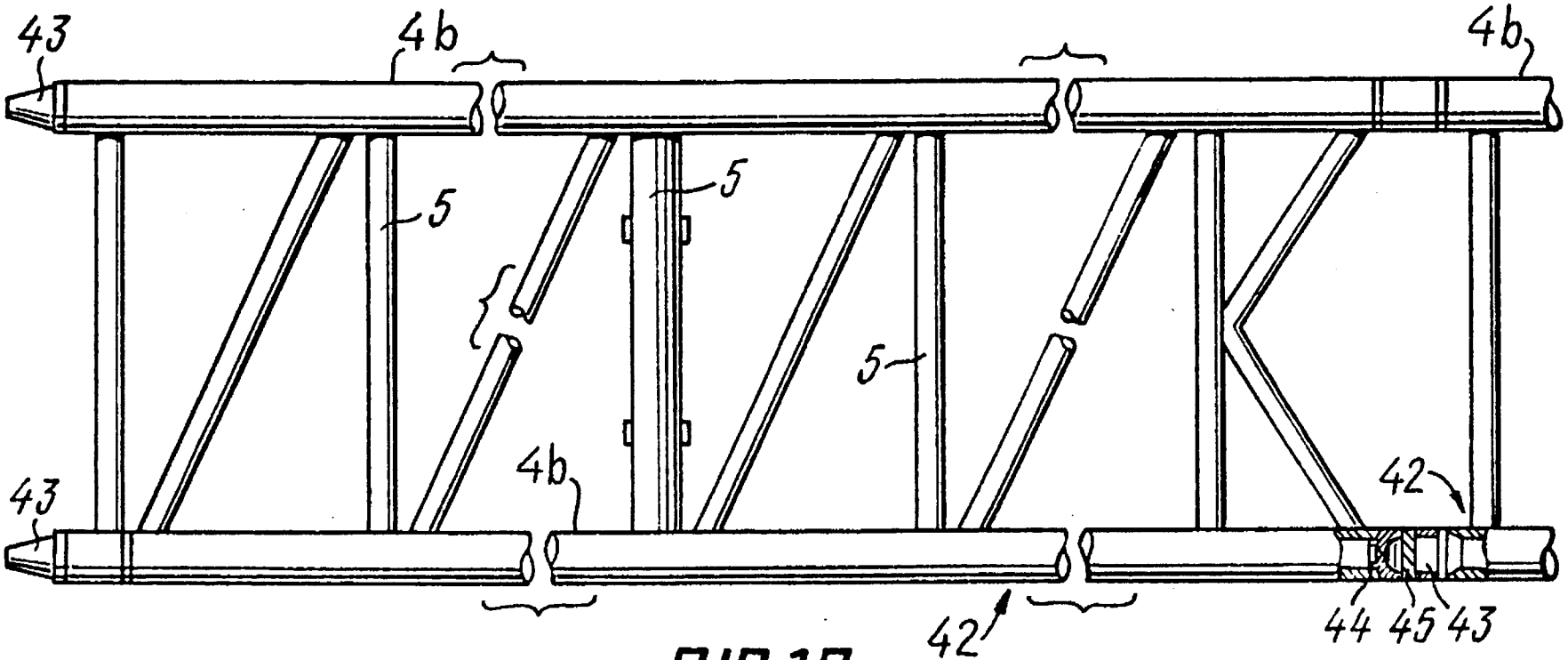
FIG. 13 is a plan view of a part of two sections of the track.

The roller coaster according to the invention has supporting elements 1 (FIGS. 1 and 7) mounted on any known base 2 and to which posts are joined at one of its ends. Posts 3 support rail track 4 on their other ends, the rails being interconnected with cross-bars 5 (FIG. 13). The path of the track is a closed trajectory for the movement of passenger cars 6 (FIG. 9). This path presents a spatial figure with changing curvature of successive sections. The set of the indicated sections includes: section 7 (FIG. 2) for loading and unloading of passengers, section 8 for the powered ascent or hoisting up to the extreme or peak point 9 of the maximum height of the track; alternating sections 10, 11, 12, 13, 14 of rises and descent slopes among which peak points 15, 16 of their extreme height are located, as well as an upright, or vertical loop section 17 with the extreme or zenith or peak point 18.

Figure 1:
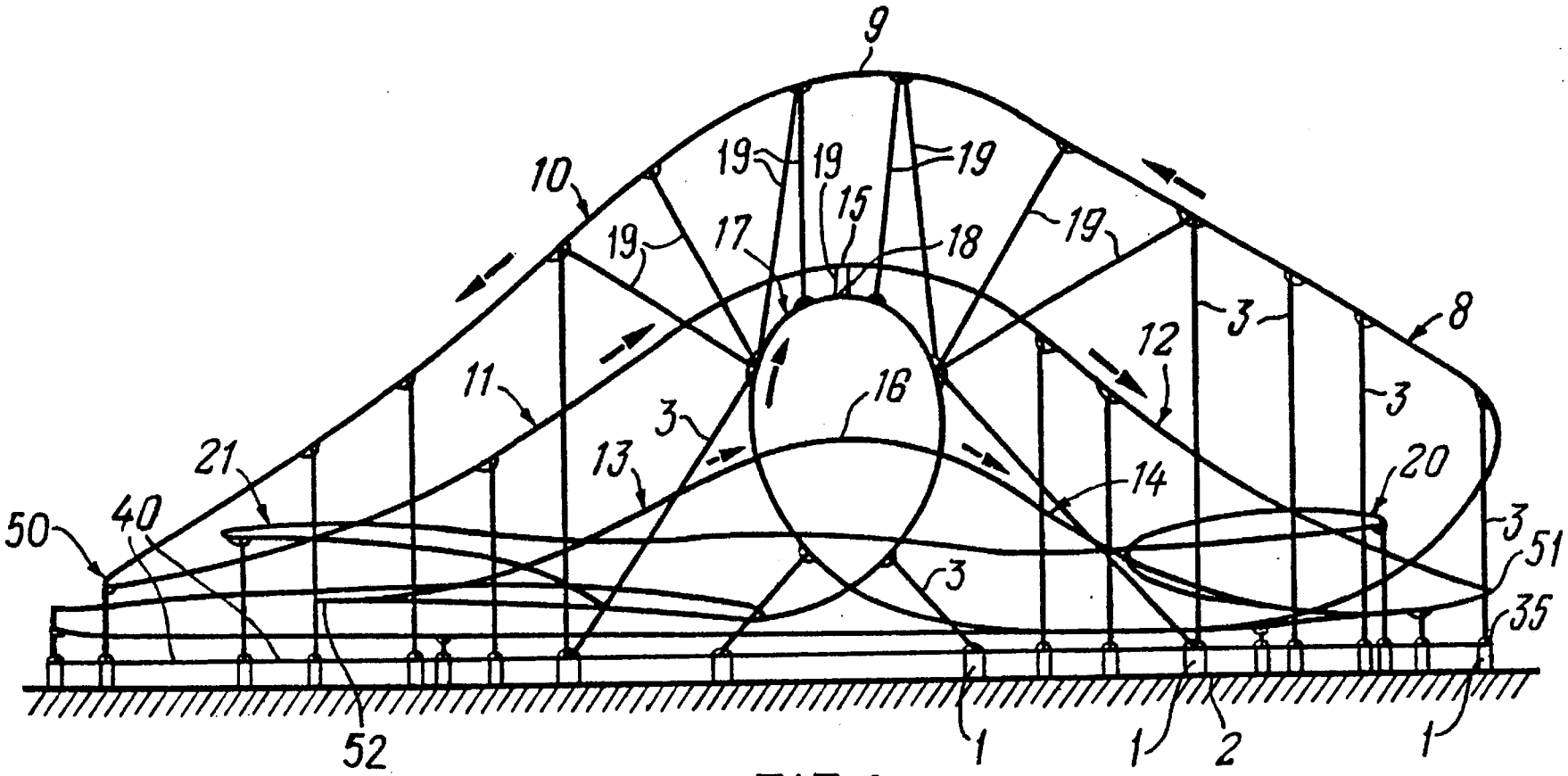
FIG. 1 is a diagram of the frontal projection of the roller coaster in accordance with the invention.

In accordance with a feature of the invention, at least one of the sections 8, 10 is situated in the area between the planes of the entrance and exit of loop section 17. The respective section 8, 10 is installed above the at least one loop section 17 and is connected with it by means of the additional posts 19. Posts 19 have been omitted, for clarity, from FIG. 2, and only some of the posts 3 and 19 are shown in FIGS. 1 and 3 to illustrate the general arrangement. Additional stiff posts 3 and 19 can be placed, as required, for strength, stiffness, and safety.

It should be noted that for the increased stiffness the loop section 17 is connected with the section of the track above the loop 17 at point 15, that is, at the zenith or peak of the loop 17.

Figure 2:
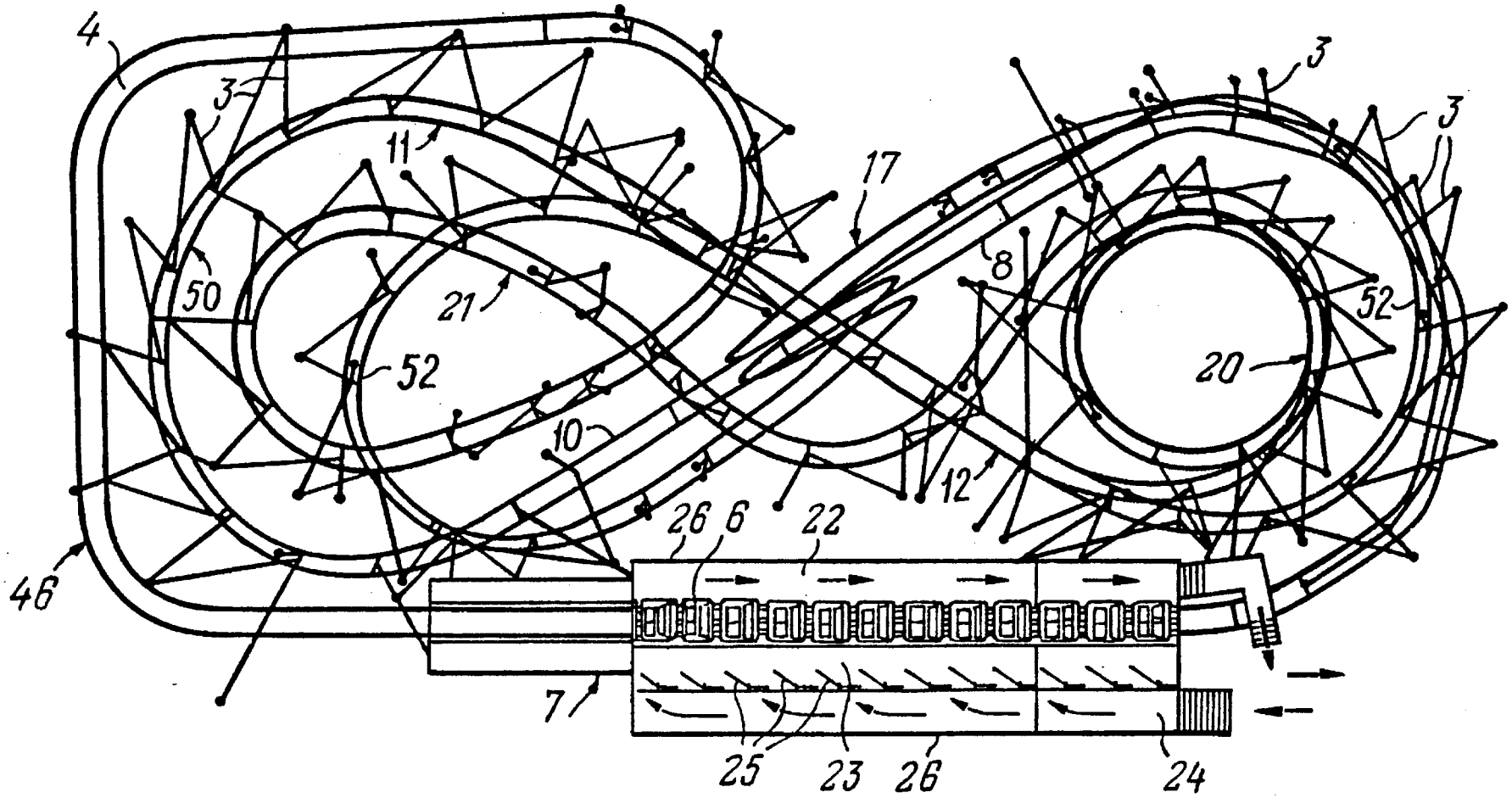
FIG. 2 shows the roller coaster in plan view.
Figure 2A:
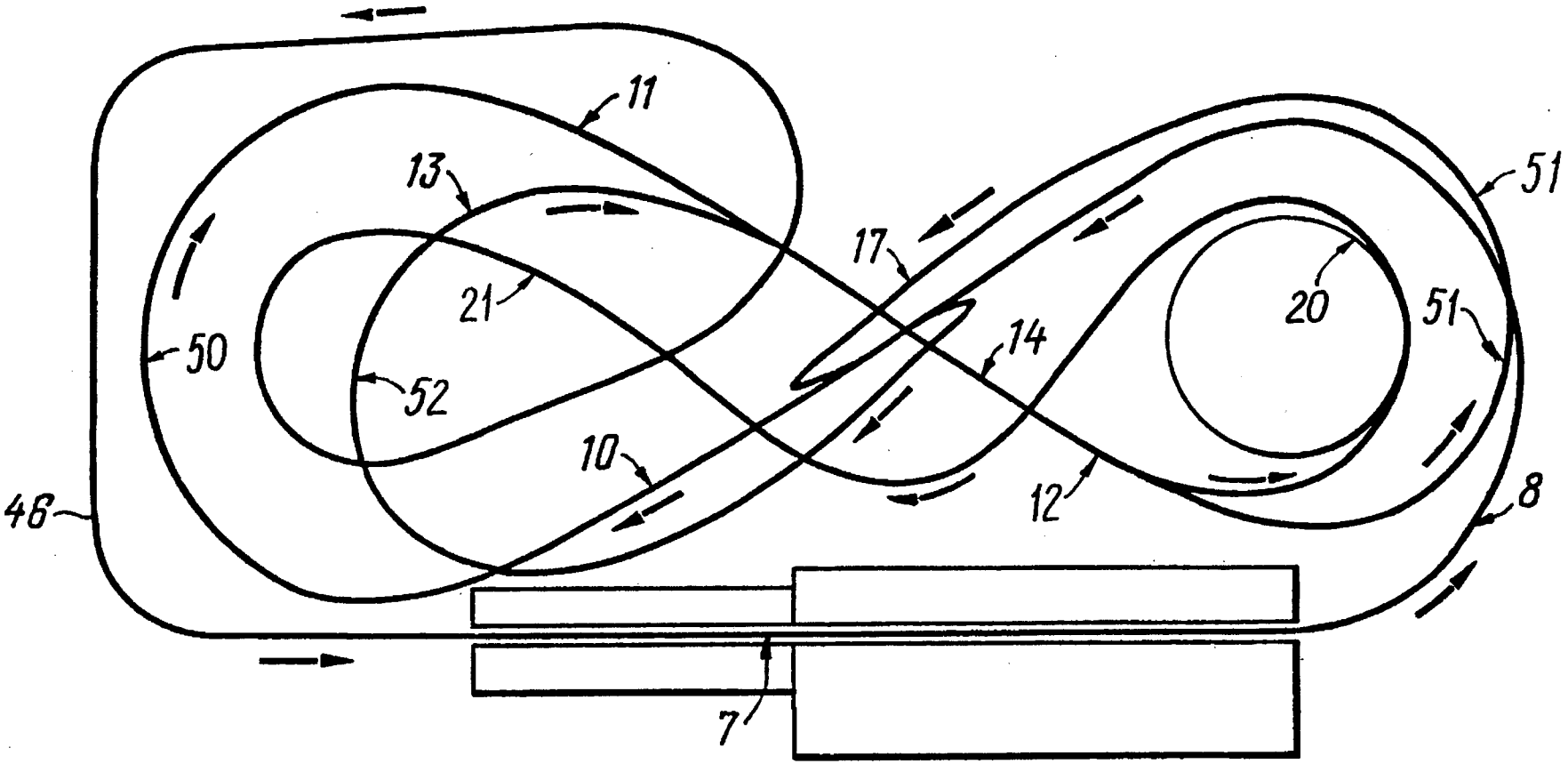
FIG. 2A is a diagrammatic plan view of the track layout of the roller coaster of FIG. 2.
Figure 3:
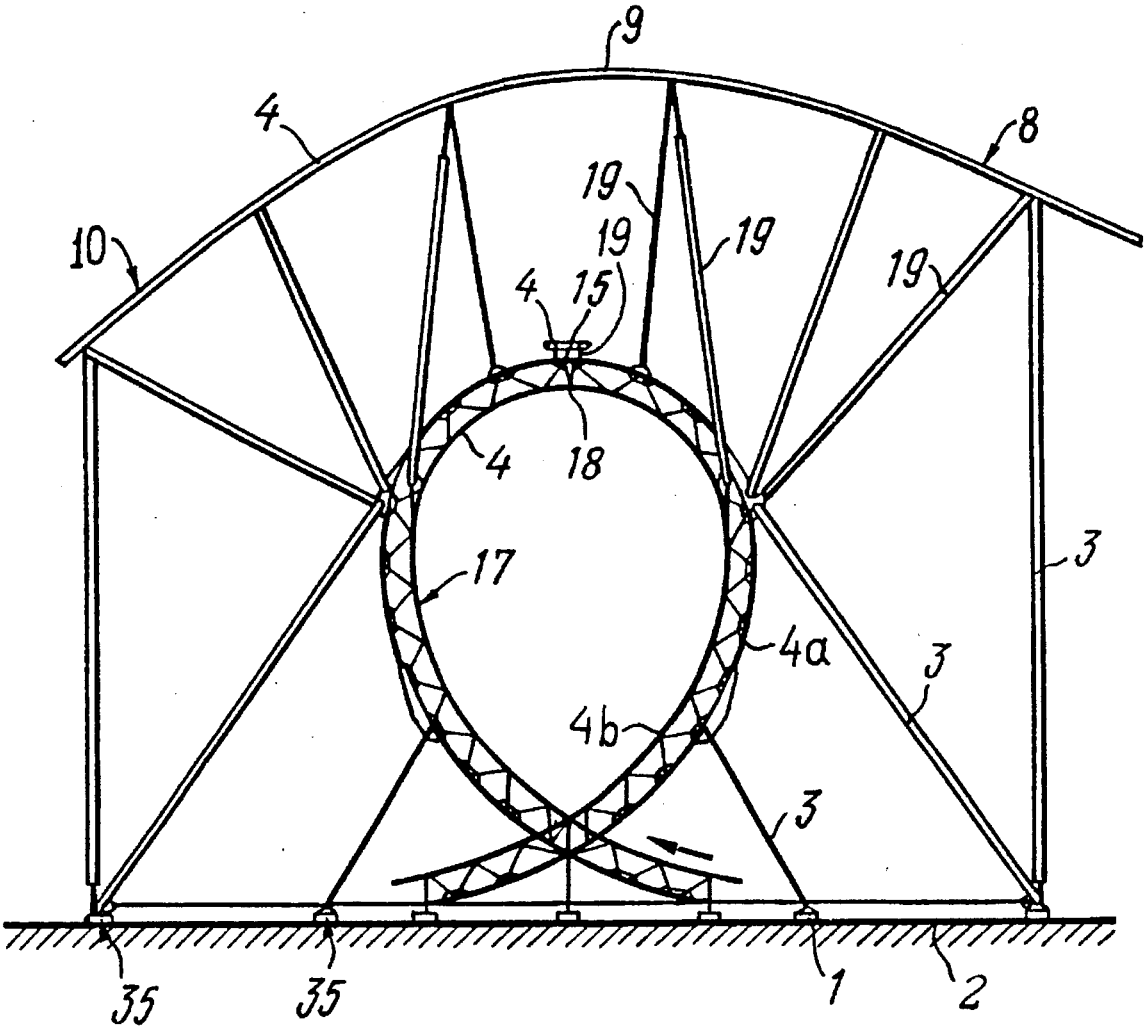
FIG. 3 shows a part of the track with the loop sections.

As can be seen in FIGS. 2 and 3, the successive arrangement of the track sections considerably increases the stiffness of the structure as a whole and in particular of the loop section 17, due to the additional ties of the loop with the sections 8, 10 and 11, 12 passing above it in mutually perpendicular planes. The weight of these sections and additional posts 19 increases the stability of the loop section 17 against tipping over. The spatial figure of the track has extreme or peak or zenith points 9, 15, 16 of successively diminishing heights located in the central part of the projection of the track of loop 17 on the vertical plane, and located in the area of the loop section 17.

On different sides of the peak points 9, 15, 16, 18 there are sections 8, 10, 11, 12, 13, 14 of ascent and descent connected to at least one ascending spiral section 20 which is disposed on one side of the loop section 17 and to at least one S-shaped section 21 located on the other side.

Figure 4:
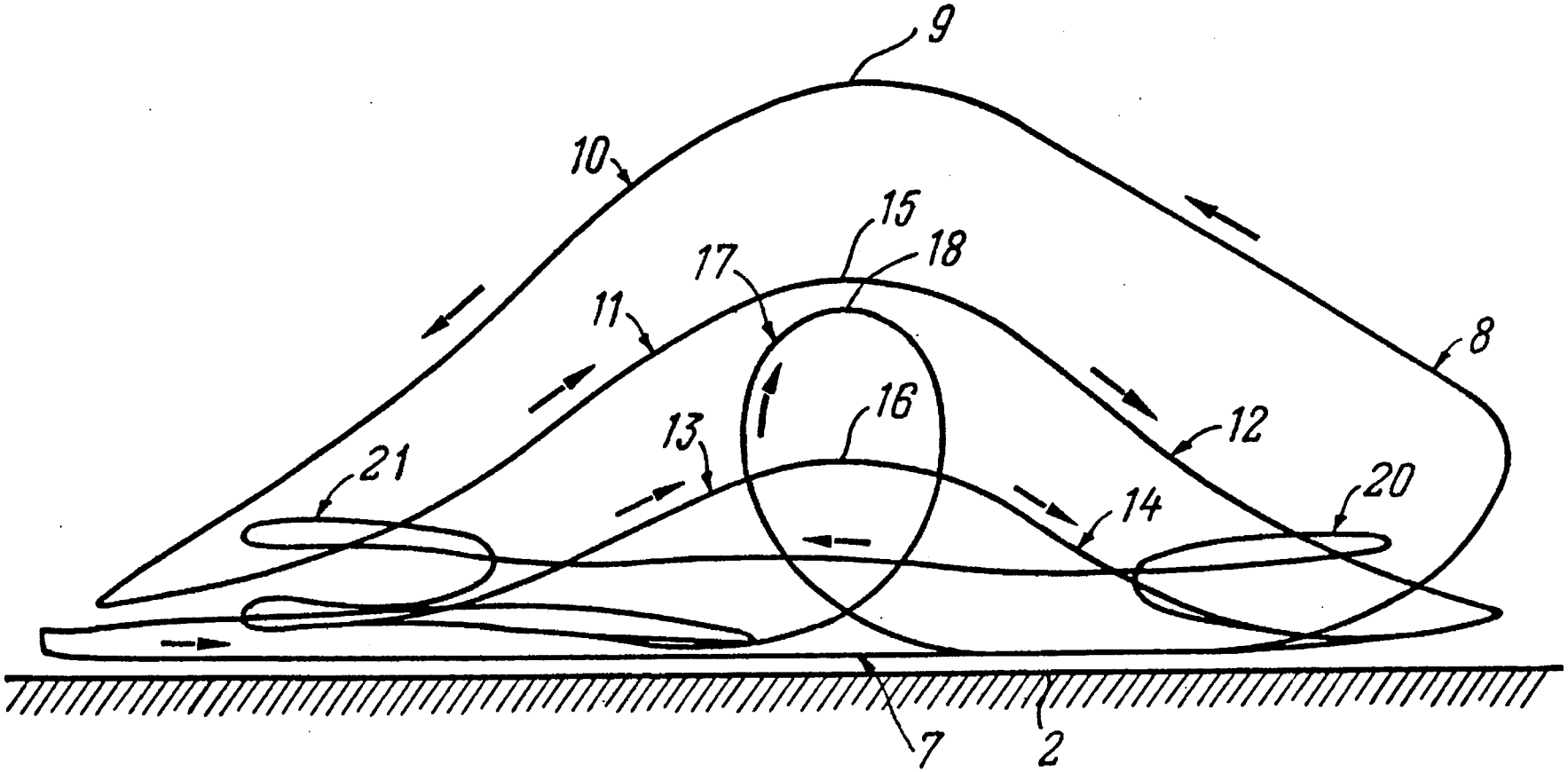
FIG. 4 shows is a frontal projection of a variant of the track with two spiral sections on different sides of the loop section.
Figure 5:
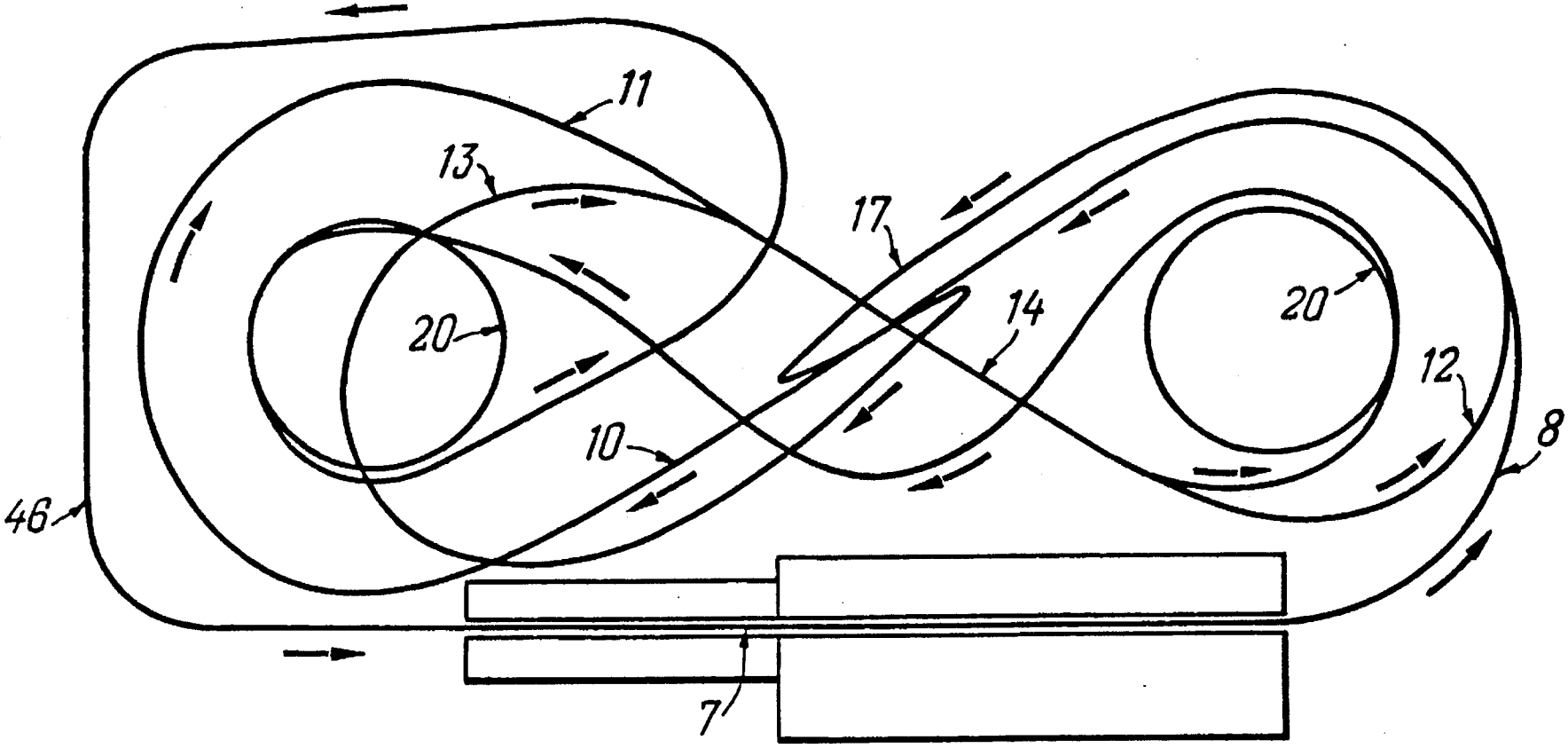
FIG. 5 is a plan view of the track of FIG. 4.
Figure 6:
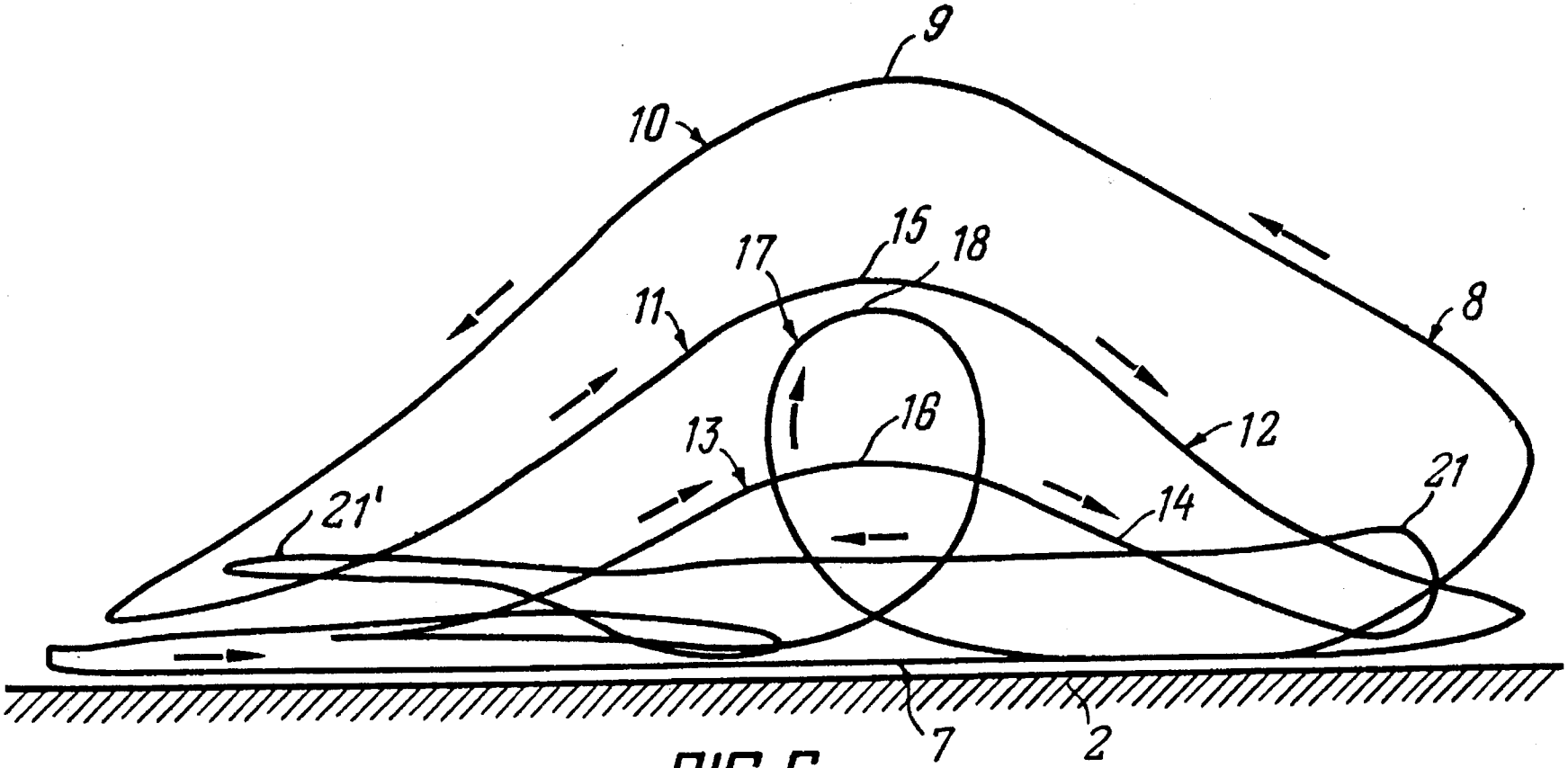
FIG. 6 is a frontal projection of a variant of the track with two S-shaped sections on different sides of the loop section.
Figure 7:
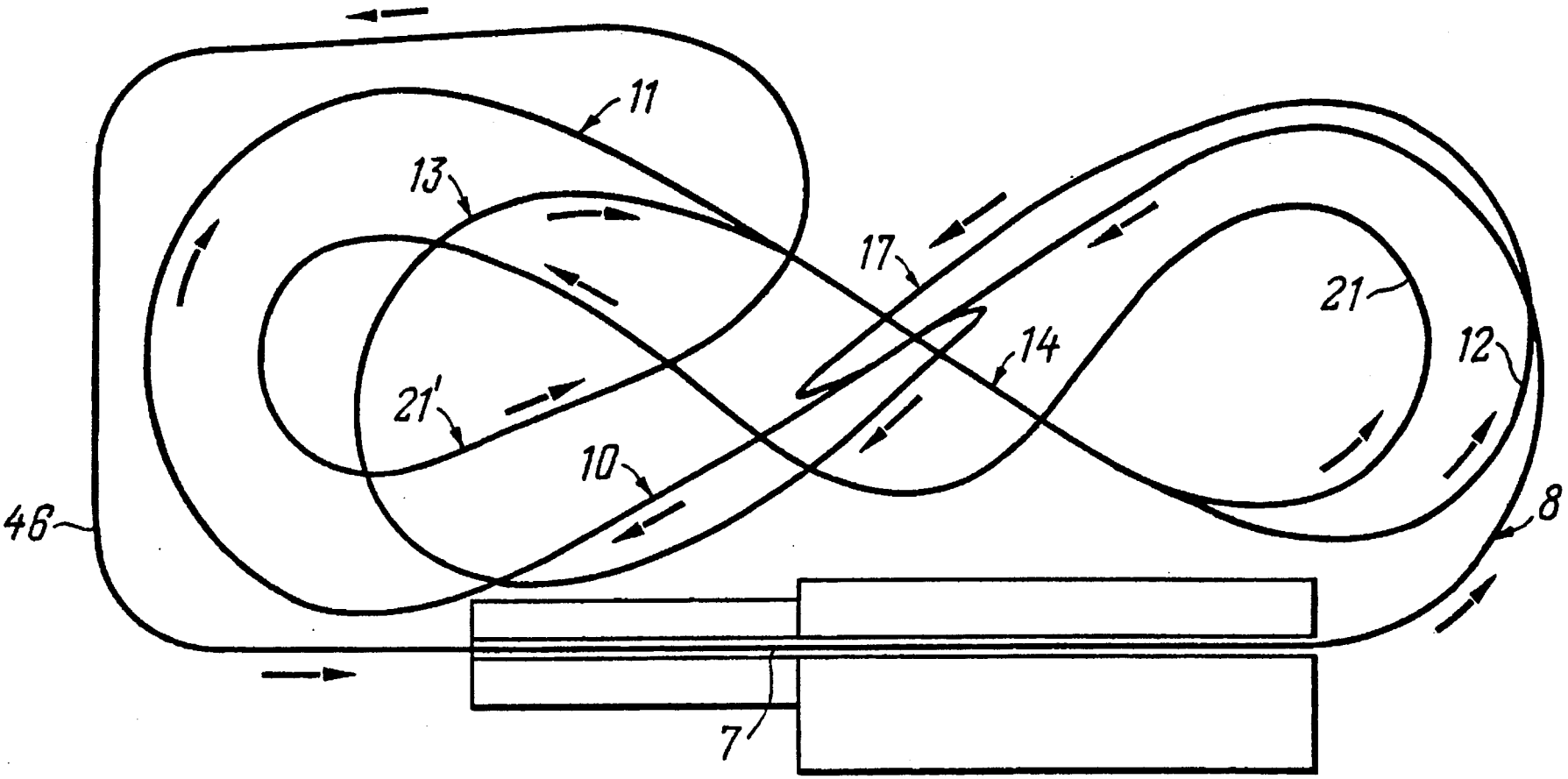
FIG. 7 is a plan view of the track of FIG. 6.

In accordance with other embodiments of the invention, the track is formed with a number of spiral sections as shown in FIGS. 4 and 5 or with several S-shaped sections as shown in FIG. 6 and 7. In FIGS. 6 and 7, the left S-shaped section is a "reverse S", identified by 21'.

Figure 8:
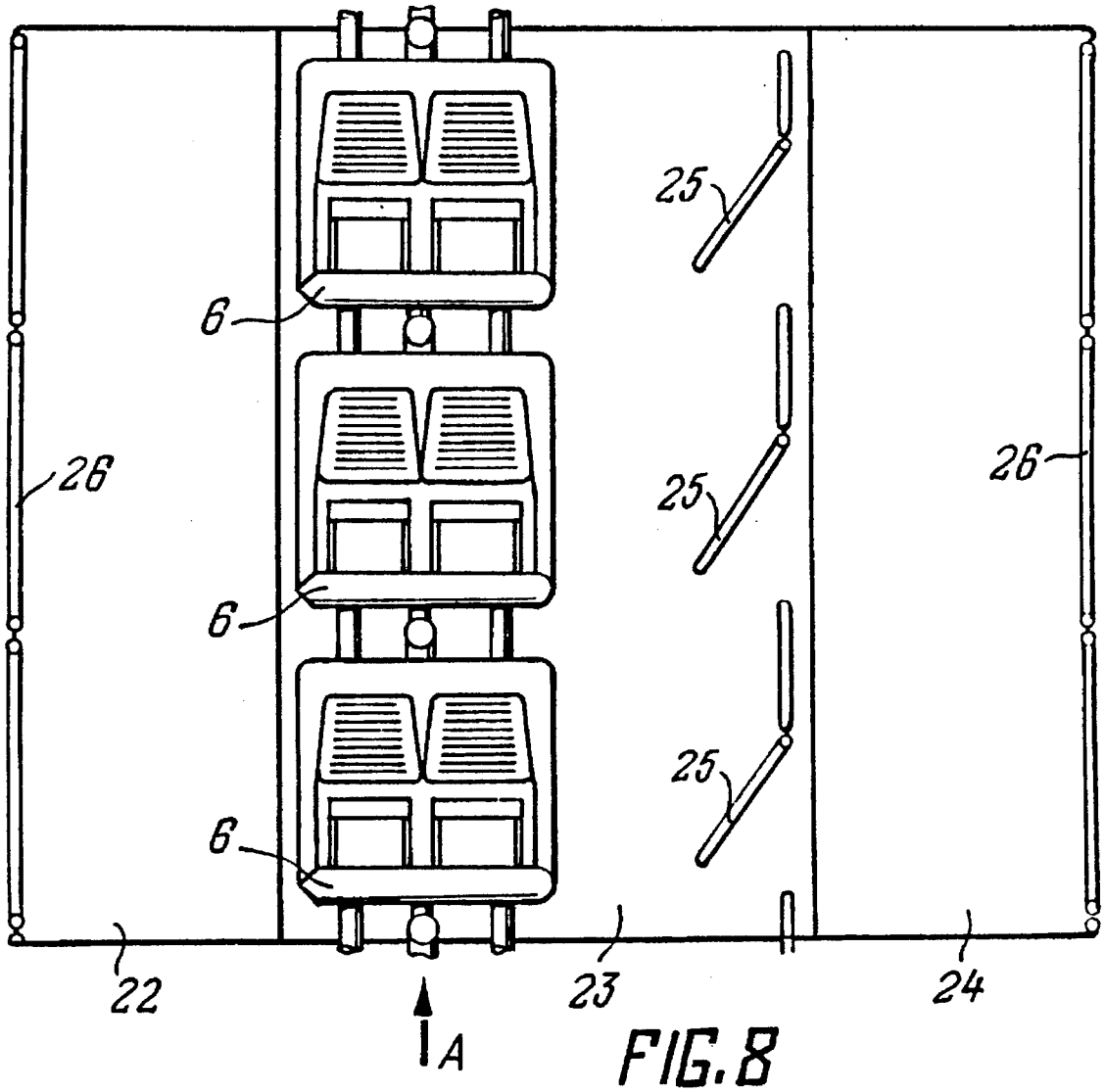
FIG. 8 is an enlarged top view of the loading/unloading platform.

In accordance with a feature of the invention, section 7 for the loading and unloading of passengers (FIGS. 2, 8, 9) is made up of at least three parts 22, 23, 24 which are hinged together. In the central part 23 there is located a section of the track with rails and turnstiles 25 for admitting passengers before loading. Fencing or guards 26 are assembled along the edges of parts 22 and 24. Platforms are connected with the central part 23 by a hinge having a hinge axis 23*a*. The width of parts 22, 24 and the height of guards or fencing 26 are designed such that after assembly they form a container for transport of the joined cars. The intermediate and the assembled states of the container are shown by the chain-dotted and dashed lines, respectively, in FIG. 9 upon pivoting of sections 22, 24 about their hinge axes. If appropriate, sections 22 and 24, in use, can be supported at ground level, or on any suitable foundation.

Figure 10:
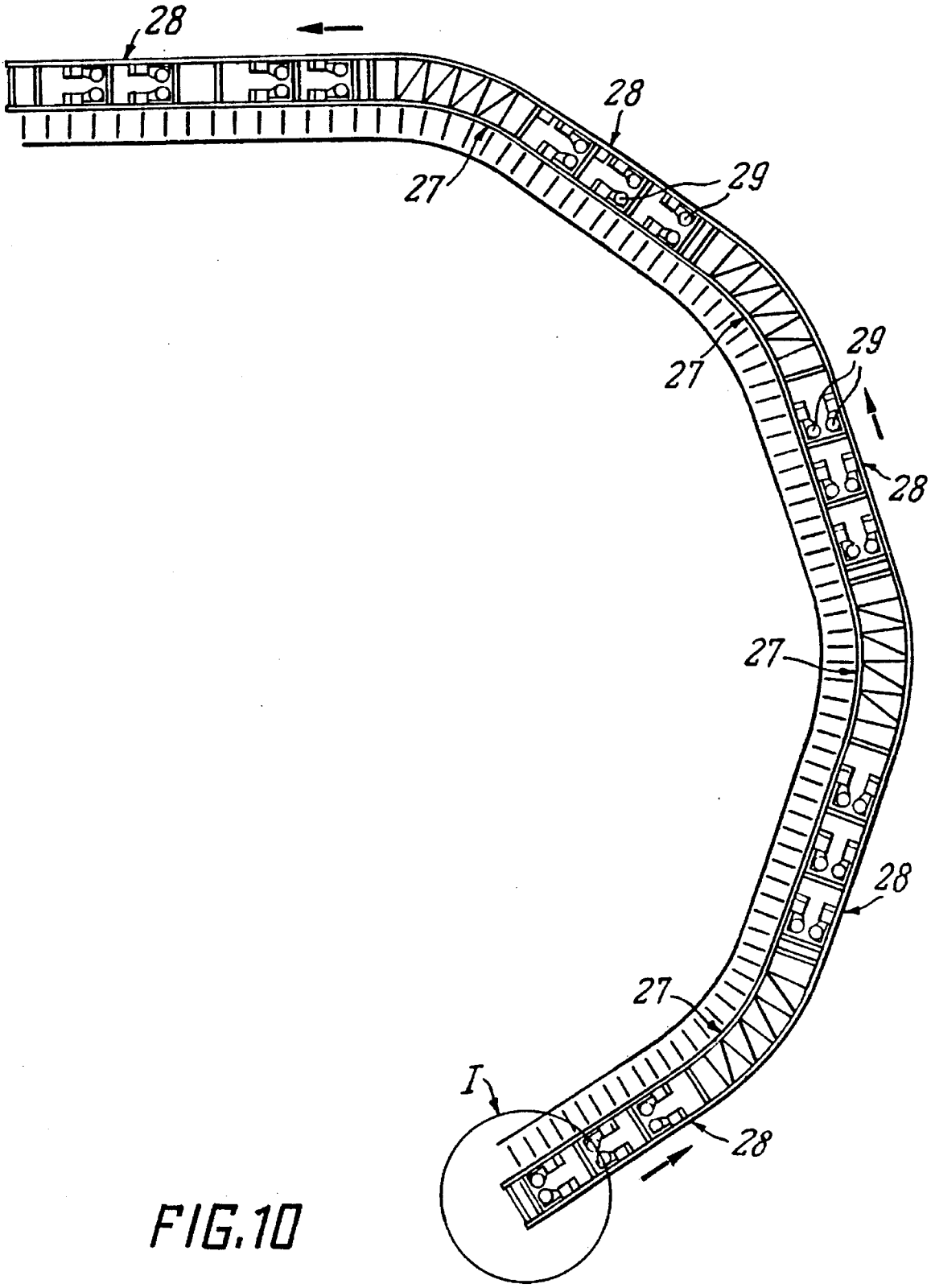
FIG. 10 is an enlarged section of the powered ascent or hoist up the track, in plan view.
Figure 11:
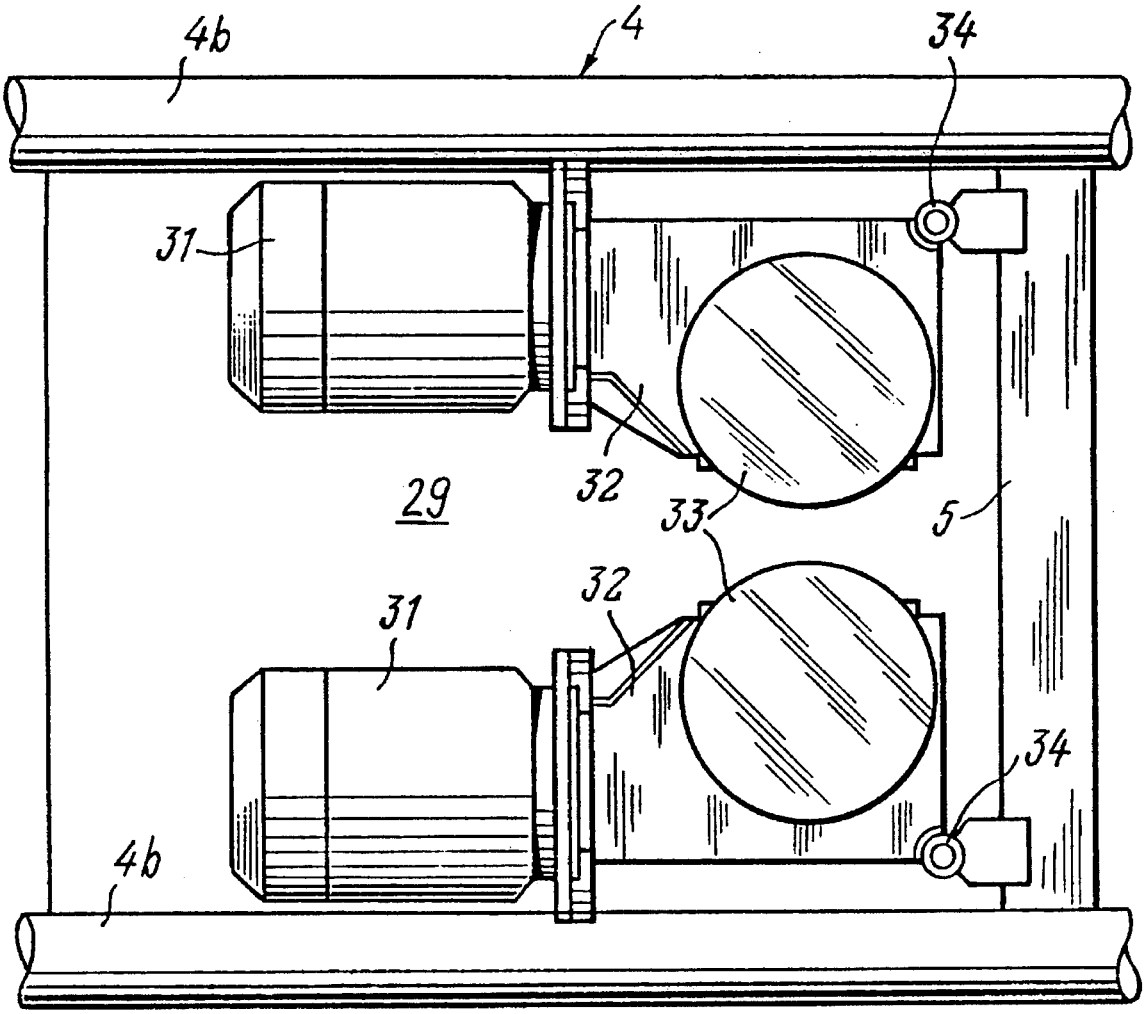
FIG. 11 is a plan view to an enlarged scale of a power unit, within circle I of FIG. 10.

The hoisting section 8 of FIG. 10 is located directly behind section 7 for passenger loading and unloading. Section 8 extends as far as top peak point 9 of the maximum height of the track. Section 8 (see FIG. 10) is formed of curved sections 27 and straight sections 28 of the track 4. Driving mechanisms 29 interacting with depending, plate-like element 30 (FIG. 9) of cars 6 are installed in pairs on the straight sections 28. Each driving mechanism 29 includes for example two electric motors 31 (FIG. 11), each of which is connected through reducing gear 32 with a roller 33 providing friction drive contact with element 30 of cars 6.

In accordance with an embodiment of the invention, two or more driving mechanisms 29 may also be installed on section 7 for loading and unloading of passengers. Each driving mechanism 29 is connected through hinge 34 with cross-bar 5 of the track 4, the hinge 34 being installed in the point closest to the nearest corresponding rail of the track 4. Motors 31 are backed up against suitable abutments on track 4. This permits disassembly for transport of the heavy gear—motor assembly and permits floating engagement of rollers 33 with plate element 30 of the cars.

Figure 12:
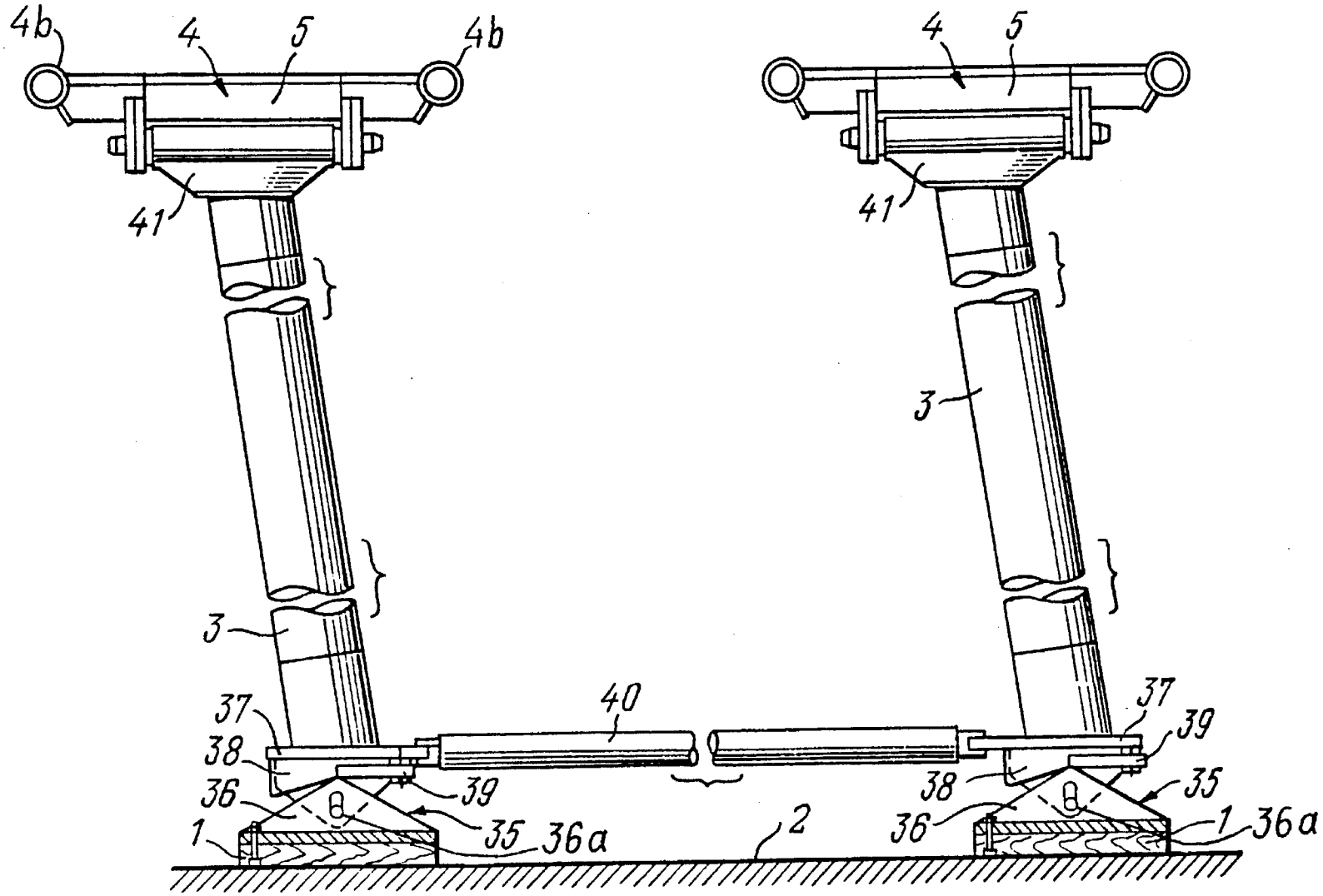
FIG. 12 is a front view of the post attachment of the two adjacent sections.

Supporting elements 1 are connected with posts 3 by means of an intermediate unit 35; an example is shown in the enlarged view of FIG. 12.

In accordance with a feature of the invention, intermediate unit 35 includes support element 36 and thrust bearing plate 37 to which the lower end of post 3 is fastened. An adjustble wedge 38 connected with screw 39 to plate 37 is placed under thrust bearing plate 37. The thrust bearing plate is hinged by pin 36*a* to support and coupling element 36 secured to support element 1. Element 3 may be in form of two spaced upwardly extending plates. Upon rotating screw 39, wedge 38 is displaced as a result of which the distance between support 36 and thrust bearing plate 37 is changed. The hinged connection of the thrust bearings with the support elements 35 permits installation of supports 3 at a predetermined angle to each other. This is necessary for the assembly of posts 3 on the base 2 whose surface may be of any configuration. Unit 35 permits strictly horizontal positioning of all thrust bearings in one plane. Pin 45 should not extend beyond rails 4 to permit smooth rolling of wheels on cars 6. Thrust bearings 37 of adjacent posts 3 can be hinged together with tie-rods 40. The upper ends of posts 3 are hinged to cross-bars 5 by means of gussets or flared supports 41. As can be seen in FIG. 13, track 4 is made up of sections 42 that are interconnected by means of conical elements 43 that enter into corresponding elements 44 with an interior cone. A through-hole in the conical elements 43 is intended for installation of pin 45 to lock two sections 42 together. In loop 17, a third tube 4*a* (FIG. 3) is placed between the track tubes 4*b* of track 4, connected thereto by suitable braces, so that the track will be, in cross section, essentially triangular. Posts 19 are coupled to the center tube 4*a* of track 4 in any well-known and suitable manner. The other end of posts 19 are connected to the track sections above the loop 17.

Operation—a ride on the roller coaster

Prospective riders go along platform 24 through turnstiles 25 to section 7 for loading into cars 6. The initial movement of the cars 6 may occur under the action of the driving mechanisms and/or under force of gravity.

The train, formed of cars 6 joined together, starts moving towards powered hoist section 8 which it surmounts by the interaction of driving mechanisms 29 with elements 30 of cars 6. After the train has been hoisted up to the extreme or peak point 9 of the maximum height of the ride, it starts movement, under force of gravity, along section 10 of the slope. Thereafter, it passes a banked section turn 50 with a great pitch angle and then goes to ascent section 11 as far as the extreme or peak point 15. During the ascents, on sections 8 and 11, riders can see the upright loop 17. Peak point 15 is lower than point 9. The train further descends along section 12 on the opposite side of peak point 15 and arrives at another banked turn 51. After these ups, downs and turns, with a great pitch angle, the train then runs to the upright loop section 17. The extreme or peak point 18 has a height which is less than the height of points 9 and 15. Then, after going through loop 17, and one more banked turn at point 52, the train passes through the peak point 16 located inside the loop section 17. Peak 16 has the least height of all the peak points. The train then goes up the ascending helix section 20, after which it goes down reverse S-shaped section 21' and on to braking section 46 (FIG. 2) which is provided with a suitable braking apparatus, as well known in this field. One can use as a braking apparatus, for example, driving mechanisms 29 which operate in the energy recuperation mode. As a result the speed of the train becomes minimal and the train stops at the unloading section 7. Passengers get out of the cars onto platform 22.

It should be noted that the above-described operation of the ride intensifies the excitement felt by the passengers as it is full of various thrilling effects which follow each other harmoniously. During the first phase, after a rather lengthy hoisting to the highest point on the track, the emotional impact is created both by the height itself and by the following fast alternations of steep slopes and rises with banks, and 180° turns. At the end of this first phase, sections 8, 9, 10, turn 50, sections 11, 12 and turn 51, the train shoots upright loop section 17, and then through it. Before entering the loop section 17, the rider can see it from the car. All above-described sections are positioned along the maximum length diagonals, the main feeling of weightlessness and high g-forces, respectively, in short, g-forces, also referred to as overloading vector, passing principally in the vertical plane as is customary. The second phase of the ride, beyond loop 17, gives a powerful sensation to the passengers. The main stress or g-force vector is now principally in the horizontal plane. The overall unusual direction of movement is conducted up a rising helix and/or along the S-shaped sections 20, 21, 50, 51 of the track. This includes a number of successive 180° turns.

The same thrilling possibilities are also inherent in the above-mentioned track arrangements (FIGS. 4, 5 and 6, 7) which contain a few spiral sections along one of which the movement is ascending and along the other descending, and several successive S-shaped sections. The ride, thus, has a first up-down turn phase; then follows the upright loop 17, followed by a second up-down turn and/or helix and/or S phase, until the train brakes in section 46. Placing the loop 17 between the first and second phases enhances the enjoyment of the rid, while permitting improved rigidity of the structure by use of posts 19 in addition to the posts 3.

Basically, the essence of the invention lies in the following. The roller coaster has a track with a closed path for the movement of passenger cars along it. This track is made up of several successive sections 8–18 whose assemblage presents a spatial figure of variable curvature. Such a track has high amusement potential due to the heightening of sensations during the progression of the ride. This is accomplished through the formation of the spatial figure of the tracks in the form of a number of extreme points 9, 15, 16 of successively diminishing height, these points being disposed in the central part of the track and including turn sections 20, 21, 21', 50, 51. Some parts of the track are located above this loop section 17 or inside of it. The rising and descendingly sloping sections 8, 10; 11, 12; 13, 14 of the track on each side of the extreme or peak points which alternate with banked turns. The turns have a substantial angle, for inclination of the cars on the track with respect to the horizontal. The descent from the section 14 from the peak 16, which is the lowest of all the peaks, passes on to an ascending helix section 20 with a vertical axis; the track then continues to an S-shaped section 21. The above alternation of the track sections creates a thrilling effect on the passengers. This effect is enhanced as the train passes through a track with a number of spiral or S-shaped sections 20, 21, 21'.

Practice has shown an insufficient rigidity of the loop sections when the number of supports and the overall dimensions of the roller coaster are a minimum. In the structure of the invention the stiffness of the loop sections and of the structure as a whole is achieved by installation of additional posts 19 which connect the upright loop section 17 and its peak 18 with the sections 8-9-10 and 11-15-12 of the track passing above it.

In order to provide a single horizontal plane for the bases on which the posts 3 are mounted, intermediate units 35, in the form of two components 36, 37, 38 which are hinged together are used. An adjustable wedge 38 is so installed that the changing of the angle and the height of each post 3 secured to the unit 35 can be adjusted. The loading/unloading platform is made up of at least three parts 22, 23, 24 which are hinged together. This allows easy transformation of this section into a container with a stiff bottom and two stiff side walls for transport of the train.

The roller coaster, in accordance with the invention, provides a compact, small-size structure with a heightened thrilling effect; the structure is easily transported and conveniently erected on-site.

The present invention can be most efficiently used in amusement parks, fairs, exhibitions and other places of leisure in order to provide the rider with excitement and thrilling sensations.

This ride can be assembled on any base; a specific configuration is not required.

Only a few of the possible variants of the structure of the invention intended for conveying passengers along a track with a complex closed configuration have been illustrated. Various changes and modifications may be made, and any suitable arrangements, for example with a plurality of loop sections 17, can be designed, without departing from the scope of the present invention.

I claim:

1. A roller coaster having a closed path track (4) for supporting passenger cars (6), said track forming a plurality of track sections, one of said sections forming passenger loading and unloading sections, wherein said passenger loading and unloading sections (22, 23, 24) comprise a three-part section having a central part (23) supporting part of said track (4), and two lateral parts (22, 24) positioned adjacent said central part (23) and hingedly connected to said central part for pivoting about an axis extending essentially parallel to the track portion on the central part (23), said lateral parts (22, 24) being formed with fence means (26) extending upwardly from said lateral parts, said fence means and said lateral parts being dimensioned and shaped to permit pivotable folding of said lateral parts over the central part (23) while clearing and covering cars (6) located on said track to form a compact shipping unit enclosing said cars.

2. A roller coaster having supporting elements (1, 35) mounted on a base main bearing posts (3) having one end coupled with said supporting elements (1, 35);

a closed path track (4) for supporting passenger cars (6), said track being attached to the other ends of said posts (3), said track forming a plurality of track sections, wherein successive sections of said track present a spatial figure of varying curvature, some of said sections forming loading and unloading sections for passengers, other sections forming hoisting ascent sections (8), at least one of spiral section (20), S-shaped sections (21, 21'), gravity descent sections (10, 12, 14), dynamic ascent sections (11, 13) and braking sections (46);

wherein at least one of said sections is an upright loop section (17) in which the loop is in an essentially vertical plane, at least one of said other track sections (10, 11, 12, 13, 14) is located in the area between planes of entrance and exit of said upright loop section (17), and located at a level above the peak (18) of the loop of the upright loop section (17); and wherein additional stiff posts (19) are provided, coupled to and connecting said upright loop section (17) with said at least one of said other track sections (8, 9, 10, 11, 12, 13, 14) located above the upright loop section (17) and positioned at least in the area between the planes of entrance and exit of the upright loop section.

3. The roller coaster of claim 2, wherein the spatial figure of the track (4) includes a plurality of peak points (9, 15, 16) of successively diminishing heights, located in the central portion of a projection of the track, in a vertical plane, said peak points being located one under another, and positioned in the area of the at least one loop section (17);

wherein sections of dynamic ascent (13) and descent (14), located on respectively opposite sides of one said peak point (16) are connected to at least one of: said spiral section (20) and said S-shaped section (21).

4. The roller coaster of claim 3, wherein said spiral section (20), in the direction of travel of the cars (6) is an ascending spiral.

5. The roller coaster of claim 2, wherein said supporting elements (1, 35) comprise a base (1) and a post attachment element (37), said post being securely coupled to said post attachment element; and an intermediate connecting structure (36, 28, 39) which angle and height adjustably couples said base (3) to said post attachment element (37).

6. The roller coaster of claim 5, wherein said intermediate connecting structure comprises a wedge element (38) and an adjustable locking plate (39) , adjustably positioning said wedge element (38) within said intermediate connecting structure.

7. The roller coaster of claim 2, wherein said passenger loading and unloading sections (22, 23, 24) comprise a three-part section having a central part (23) supporting part of said track (4), and two lateral parts (22, 24) positioned adjacent said central part (23) and hingedly connected to said central part for pivoting about an axis extending essentially parallel to the track portion on the central part (23), said lateral parts (22, 24) being formed with fence means (26) extending upwardly from said lateral parts, said fence means and said lateral parts being dimensioned and shaped to permit pivotable folding of said lateral parts over the central part (23) while clearing and covering cars (6) located on said track to form a compact shipping unit enclosing said cars.

8. The roller coaster of claim 2, wherein part of at least one of said track sections (13, 14, 16) passes through said loop (17).

9. The roller coaster of claim 8, wherein the roller coaster includes cars (6) adapted to travel in a predetermined direction; and wherein at least one of: said spiral section (20) and said S-shaped section (21) is located, respectively, in the direction of travel of said cars, in advance of passage of part of said track section through the upright loop (17) and another one of said at least one sections is located beyond said upright loop.

10. A roller coaster having supporting elements (1, 35) mounted on a base main bearing posts (3) having one end coupled with said supporting elements (1, 35);

a closed path track (4) for supporting passenger cars (6), said track being attached to the other ends of said posts (3), said track forming a plurality of track sections, wherein successive sections of said track present a spatial figure of varying curvature, some of said sections forming loading and unloading sections for passengers, other sections forming hoisting ascent sections (8), at least one of spiral section (20), S-shaped sections (21, 21'), gravity descent sections (10, 12, 14), dynamic ascent sections (11, 13) and braking sections (46);

wherein at least one of said sections is an upright loop section (17) in which the loop is in an essentially vertical plane, at least one of said other track sections (10, 11, 12, 13, 14) is located in the area between planes of entrance and exit of a respective upright loop section (17), and located at a level above the peak (18) of the loop of the upright loop section (17);

wherein additional stiff posts (19) are provided, coupled to and connecting said upright loop section (17) with said at least on of said other track sections (8, 9, 10, 11, 12, 13, 14) located above the upright loop section (17) and positioned at least in the area between the planes of entrance and exit of the loop; and wherein at least one of:

said spiral section (20)

and said S-shaped section (21, 21') is located on one side of the loop and at least one of:

said spiral section (20);

and said S-shaped section (21, 21') is located on the other side of the loop;

wherein the spatial figure of the track (4) includes a plurality of peak points (9, 15, 16) of successively diminishing heights, located in the central portion of a projection of the track, in a vertical plane, said peak points being located one under another, and positioned in the area of the at least one upright loop section (17); and wherein sections of dynamic ascent (13) and descent (14), located on respectively opposite sides of one said peak point (16) are connected to at least one of: said spiral section (20) and said S-shaped section (21, 21').

11. The roller coaster of claim 10, wherein a spiral section (20) is located on one side of the upright loop (17) and said S-shaped section (21) is located at the other side of the upright loop.

12. The roller coaster of claim 10, wherein two S-shaped sections (20) are provided, one each located at a respective side of the upright loop (17).

13. The roller coaster of claim 10, wherein two spiral sections (21) are provided, located, respectively, at opposite sides of said upright loop (17).

14. The roller coaster of claim 10, wherein said supporting elements (1, 35) comprise said base (2) and a post attachment element (37), said post being securely coupled to said post attachment element; and an intermediate connecting structure (36, 38, 39) which angle and height adjustably couples said base (2) to said post attachment element (37).

15. The roller coaster of claim 14, wherein said intermediate connecting structure comprises a wedge element (38) and an adjustable locking plate (39) adjustably positioning said wedge element (38) within said intermediate connecting structure.

16. The roller coaster of claim 10, wherein part of at least one of said track sections (13, 14, 16) passes through said upright loop (17).

17. The roller coaster of claim 16, wherein the roller coaster includes cars (6) adapted to travel in a predetermined direction; and wherein at least-one of: said spiral section (20) and said S-shaped section (21) is located, respectively, in the direction of travel of said cars, in advance of passage of part of said track section through the upright loop (17) and another one of said at least one sections is located beyond said upright loop.

18. A roller coaster having supporting elements (1, 35) mounted on a base;

main bearing posts (3) having one end coupled with said supporting elements (1, 35);

a closed path track (4) for supporting passenger cars (6), said track being attached to the other ends of said posts (3), said track forming a plurality of track sections, wherein successive sections of said track present a spatial figure of varying curvature, some of said sections forming loading and unloading sections for passengers, other sections forming hoisting ascent sections (8), at least one of spiral section (20), S-shaped sections (21, 21'), gravity descent sections (10, 12, 14), dynamic ascent sections (11, 13) and braking sections (46);

wherein at least one of said sections is an upright loop section (17) in which the loop is in an essentially vertical plane, at least one of said other track sections (10, 11, 12, 13, 14) is located in the area between planes of entrance and exit of said upright loop section (17), and located at a level above the peak (18) of the loop of the upright loop section (17); and wherein said passenger loading and unloading sections (22, 23, 24) comprise a three-part section having a central part (23) supporting part of said track (4), and two lateral parts (22, 24) positioned adjacent said central part (23) and hingedly connected to said central part for pivoting about an axis extending essentially parallel to the track portion on the central part (23), said lateral parts (22, 24) being formed with fence means (26) extending upwardly from said lateral parts, said fence means and said lateral parts being dimensioned and shaped to permit pivotable folding of said lateral parts over the central part (23) while clearing and covering cars (6) located on said track to form a compact shipping unit enclosing said cars.

* * * * *